US009124023B2

(12) United States Patent
Eichert

(10) Patent No.: US 9,124,023 B2
(45) Date of Patent: Sep. 1, 2015

(54) HEAT AND CORROSIVE DUST DEFLECTING COVER PLATE ASSEMBLY

(71) Applicant: William F. Eichert, Kingston, NY (US)

(72) Inventor: William F. Eichert, Kingston, NY (US)

( * ) Notice: Subject to any disclaimer, the term of this patent is extended or adjusted under 35 U.S.C. 154(b) by 0 days.

(21) Appl. No.: 13/804,449

(22) Filed: Mar. 14, 2013

(65) Prior Publication Data

US 2014/0273616 A1 Sep. 18, 2014

(51) Int. Cl.
*H01R 13/52* (2006.01)

(52) U.S. Cl.
CPC ..... *H01R 13/5213* (2013.01); *H01R 13/5227* (2013.01)

(58) Field of Classification Search
USPC ..... 439/521, 135, 131, 144, 373, 374; 174/66, 67
See application file for complete search history.

(56) References Cited

U.S. PATENT DOCUMENTS

| | | | | | |
|---|---|---|---|---|---|
| 3,013,105 | A | * | 12/1961 | Craig | 174/67 |
| D270,995 | S | * | 10/1983 | Meyer | D8/350 |
| 4,618,740 | A | * | 10/1986 | Ray et al. | 174/67 |
| D301,872 | S | * | 6/1989 | Copeland | D13/177 |
| 4,886,465 | A | * | 12/1989 | Warner | 439/137 |
| D308,626 | S | * | 6/1990 | Villarreal | D8/353 |
| D309,093 | S | * | 7/1990 | Reinholt | D8/353 |
| 4,981,439 | A | * | 1/1991 | Piedmont | 439/135 |
| 5,067,907 | A | * | 11/1991 | Shotey | 439/135 |
| 5,544,025 | A | * | 8/1996 | Bohlool et al. | 362/95 |
| 5,664,955 | A | * | 9/1997 | Arnett | 439/135 |
| 5,989,052 | A | * | 11/1999 | Fields et al. | 439/373 |
| D553,475 | S | * | 10/2007 | Gorin et al. | D8/353 |
| D554,475 | S | * | 11/2007 | Gorin et al. | D8/353 |
| 7,338,309 | B2 | * | 3/2008 | Gremillion et al. | 439/373 |
| 7,390,964 | B2 | * | 6/2008 | Gorin et al. | 174/66 |
| 7,528,323 | B2 | * | 5/2009 | Wu et al. | 174/66 |
| 7,902,458 | B2 | * | 3/2011 | Eshelman | 174/66 |
| 8,445,781 | B1 | * | 5/2013 | Chasser | 174/67 |
| 2003/0220003 | A1 | * | 11/2003 | Piedmont | 439/133 |
| 2013/0330965 | A1 | * | 12/2013 | Hildebrandt | 439/559 |

* cited by examiner

*Primary Examiner* — Alexander Gilman
(74) *Attorney, Agent, or Firm* — BK Patents, Inc; Billy J. Knowles

(57) ABSTRACT

A heat and corrosive dust deflecting cover plate assembly with a heat or dust deflecting projection for protection from heat degradation of the connector of outlets, sockets, or jacks to which the cover plate assembly affixed and also affords protection from heat degradation of the electrical cord(s) or electronic cables connected to the outlet, or sockets, or connectors. The electrical outlet cover plate assembly includes base plate that includes a curvilinear deflective projection of a length to extend beyond a heat source placed below the cover plate assembly and attached by a screw or screws to wall outlets, sockets, or connectors. The base plate has openings for receiving the connectors into which the electrical or electronic cords or cables are plugged. Another embodiment of this cover plate assembly affords protection to electrical or electronic connectors and their associated electrical or electronic cords or cables from corrosive dust and other detrimental substances.

12 Claims, 3 Drawing Sheets

HEAT AND CORROSIVE DUST DEFLECTING COVER PLATE ASSEMBLY

BACKGROUND

1. Field of the Disclosure

The present invention is generally directed to the field of electrical wiring components and wall-mounted enclosures for electrical and electronic wiring devices. More particular this invention relates to wall cover plate assemblies for use with wall mounted electrical and electronic enclosures. Even more particularly, this invention relates to methods and assemblies for protecting electrical and electronic cords and cable from adjacent heat sources and for protecting the electrical and electronic enclosures from being subjected to conductive or corrosive particulate dust.

2. Description of Related Art

The Consumer Product Safety Commission Document #524 reports that electric receptacles (outlets) are involved in 5,300 fires annually which claim 40 lives and injure 110 consumers.

The U.S. Administration Fact Sheet on Home Electrical Fire Prevention (updated Nov. 23, 2004) reports that during a typical year, home electrical problems account for 67,800 fires, 485 deaths, and $868 million in property losses.

Most electrical fires result from problems with "fixed wiring" such as faulty electrical receptacles (outlets) and old wiring. Problems with cords and plugs also cause many home electrical fires. Older homes may have receptacles which are damaged or which, otherwise, have diminished integrity of their electrical insulating materials. Receptacles in this condition may overheat and pose a serious fire hazard. Deterioration accelerates with the repeated application of flowing, heated air. Outlets installed over baseboard heating elements, either electrical, hot water or forced air are continuously subjected to heated air causing diminished integrity of their electrical insulating materials.

Previous modifications to electrical outlet cover plates have been primarily to protect young children from electric shock by limiting access to the energized portions of the outlet. These modifications are also designed to protect young children by preventing the partial removal of a power receiving plug that exposes the electrified prongs to possible contact.

U.S. Pat. No. 4,671,587 1987 (Lerner) CHILD-PROOF OUTLET COVER; U.S. Pat. No. 4,250,349 (Bennett) DRAFT/FREE SAFETY ENCLOSURE; and U.S. Pat. No. 5,856,633 (Zelkonsky) ELECTRICAL RECEPTACLE PROTECTOR disclose solutions to the problem of controlling access to electrical outlets by young children.

U.S. Design patent 309,093 (Reinholt) COMBINED WALL PLATE AND ELECTRICAL PLUG SAFETY CAP and U.S. Pat. No. 4,293,733 1981 Royer SAFETY COVER FOR ELECTRICAL OUTLETS disclose solutions to the problem of preventing unnecessary plug removal from an outlet.

Lastly, U.S. Pat. No. 4,915,638 (Domain) PROTECTIVE ENCLOSURE FOR ELECTRICAL OUTLETS; U.S. Pat. No. 4,851,612 (Peckham) OUTLET PROTECTOR; U.S. Pat. No. 4,076,360 (Singh, et al.) SAFETY DEVICE FOR ELECTRICAL CONNECTOR DEVICE; U.S. Pat. No. 4,424,407 (Barbic) ELECTRICAL OUTLET SAFETY COVER; U.S. Pat. No. 4,618,740 (Ray, et al.) ELECTRICAL OUTLET SAFETY DEVICE; U.S. Pat. No. 4,691,974 (Pinkerton, et al.) SAFETY COVERS FOR ELECTRICAL OUTLETS; and U.S. Pat. No. 5,067,907 (Shotey) COVER AND SHEATH FOR ELECTRICAL OUTLETS disclose solutions for access control and plug removal problems jointly.

Although protection of young children is essential, a failure to protect the entire household has been overlooked. None of the above mentioned patents, when installed on outlets located above heated air sources, offers protection for either the outlet or power receiving cord and plug from the diminishing integrity of their electrical insulating materials and combustible effects of repeated, heated air flow.

SUMMARY OF THE DISCLOSURE

Accordingly, several objects and advantages of the heat and corrosive dust deflecting cover plate assembly are:

(a) to provide a deflecting cover plate which reduces the diminishing integrity of electrical insulating materials and the combustible effects of rising, heated air flow to connectors of wall mounted outlets and jacks and other types of electrical apparatus to which electrical and electronic cords or cables are attached.

(b) to provide a deflecting cover plate that reduces the diminishing integrity of electrical insulating materials and the combustible effects of rising, heated air flow to electrical or electronic cords or cables, which may be connected therein.

(c) to provide a deflecting cover plate whose embodiments do not limit its use to certain types of connectors.

(d) to provide a deflecting cover plate whose embodiments do not limit its use to any particular orientation of installation.

(e) to provide a deflecting cover plate which upon a specific manner of installation, becomes a deflective cover plate for descending corrosive dust and other detrimental particulate material, electrically conductive objects or substances.

(f) to provide a deflective cover plate for protecting electrical and electronic outlets and jacks from falling corrosive dust and other detrimental, electrically conductive objects, or substances.

Further objects and advantages are to provide a simple device which is easily installed by the consumer or professional tradesman, passive in use, inexpensive to manufacture and which addresses a heretofore overlooked need for reducing the diminishing integrity of electrical insulating materials and the combustible effects of rising, heated air flow on electrical or electronic connectors and the cords or cables plugged to the connectors. Still further objects and advantages will become apparent from a consideration of the ensuing description and drawings.

In accordance with the present invention, a heated air or corrosive dust deflecting cover plate assembly comprises of a baseplate, having an opening or openings therein for receiving electrical or electronic connectors. The assembly also incorporates a deflective curvilinear projection from the baseplate. The deflective curvilinear projection may be mounted to perpendicular to the baseplate or a small angle of from approximately 1° to 5° departing from the perpendicular. Conventional screw or screws, clips, snaps or other devices are used to affix the assembly to the connector of the outlet or jack. The base plate is normally affixed to a vertical wall or support with deflective curvilinear projection extending in a generally horizontal position. The small angle being sufficient to prevent any liquid or dry particulate matter from accumulating in recessed area of the deflective curvilinear projection.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE DISCLOSURE

The heat and corrosive dust deflecting cover plate assembly of this invention protects electrical and electronic connectors of outlets and jacks and the cords and cables attached to the connectors from being effected by repeated exposure to heated airflow from baseboard heaters, vents and ducts. Further, the cover plate assembly protects electrical and electronic connectors of outlets and jacks and other types of electrical apparatus from falling corrosive dust and other detrimental, electrically conductive objects or substances.

Figure 1A:
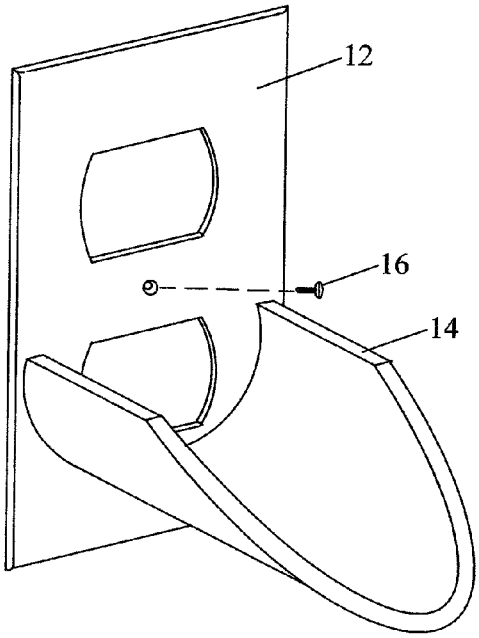
FIG. 1A shows an isometric view of a deflective cover plate of a preferred embodiment for heat deflection of this disclosure.
Figure 1B:
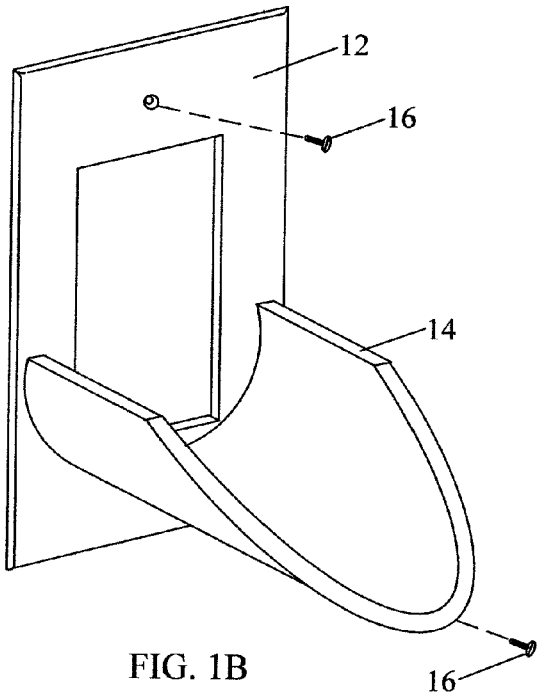
FIG. 1B shows an isometric view of an alternative embodiment of a deflective cover plate of this disclosure with respect to a specific manner of installation for heat deflection.
Figure 1C:
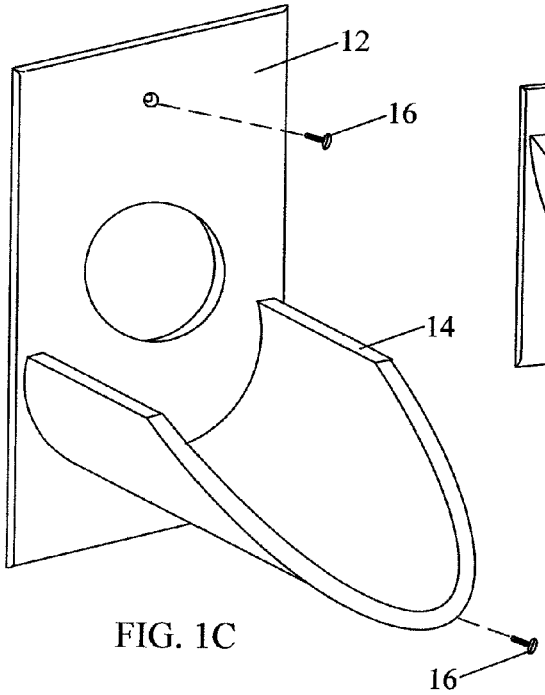
FIGS. 1C, 1D, and 1E show isometric views of other alternative embodiments of a deflective cover plate of this disclosure with respect to specific manner of installations for heat deflection.
Figure 1D:
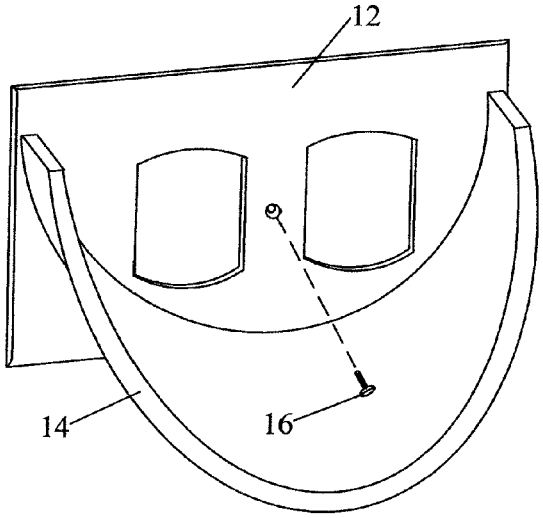
Figure 1E:
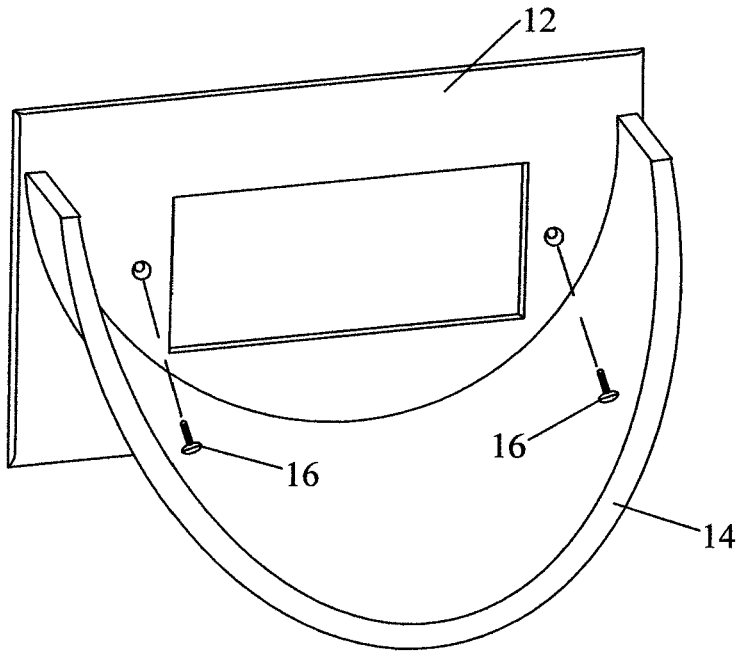
Figure 2A:
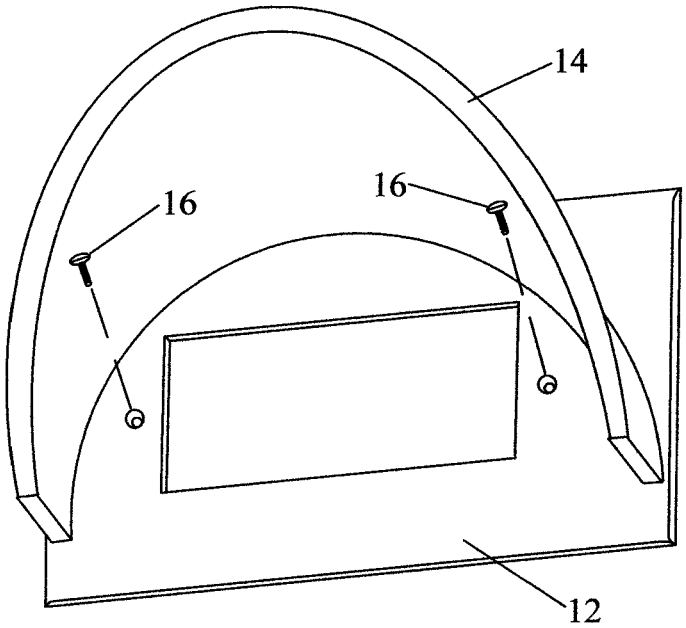
FIG. 2A shows an isometric view of an embodiment of a deflective cover plate of this disclosure for the deflection of falling corrosive dust and other detrimental, electrically conductive objects or substances.
Figure 2B:
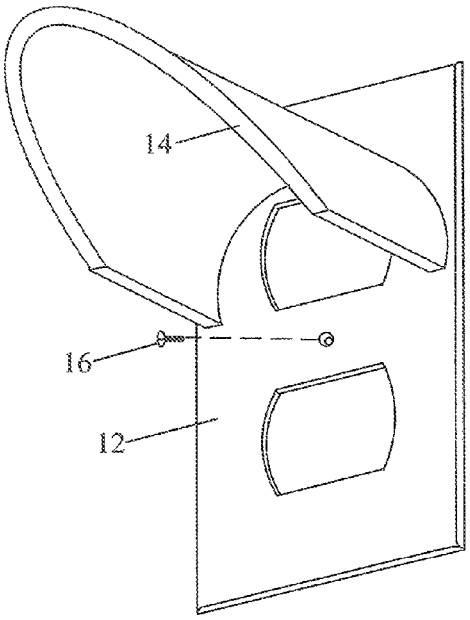
FIGS. 2B, 2C, 2D and 2E show isometric views of other embodiments of a deflective cover plate of this disclosure with respect to a specific manner of installation for the deflection of falling corrosive dust and other detrimental, electrically conductive objects or substances.
Figure 2C:
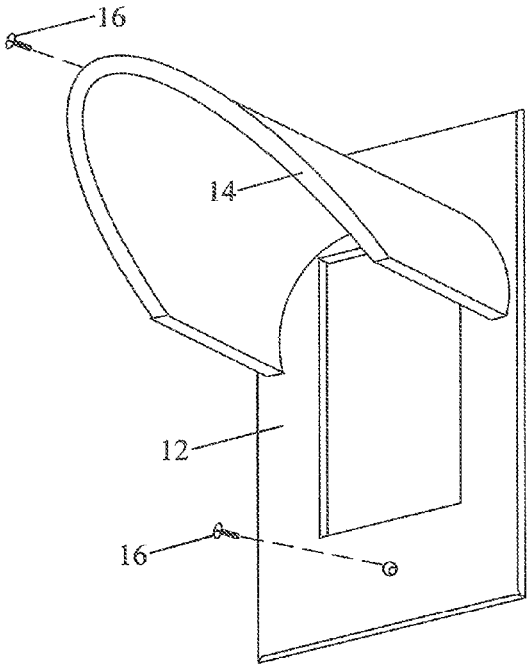
Figure 2D:
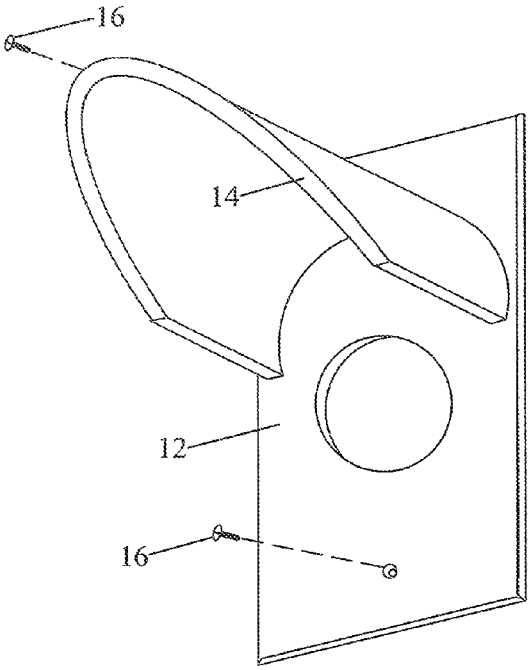
Figure 2E:
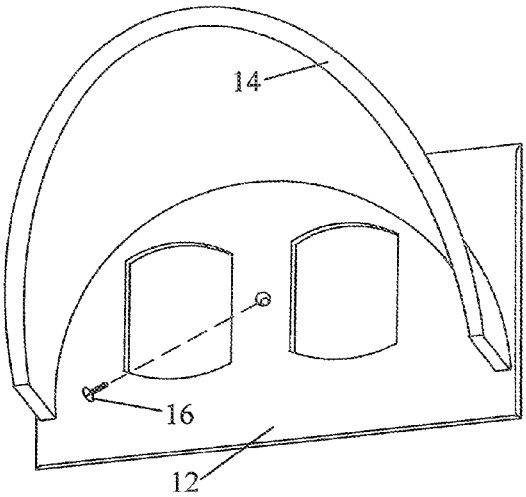

A preferred embodiment of a deflective cover plate of this disclosure is illustrated in FIG. 1A. The projection 14 is integrally molded with or attached to a Baseplate 12, with the entire assembly being connected to an existing connector by conventional screw(s) 16. In the preferred embodiment, baseplate 12 is a heat resistant material such as organic polymers or other heat resistant, moldable material that is electrically nonconductive. The deflective curvilinear projection 14 is positioned approximately perpendicular to the baseplate at an angle that deviates from perpendicular from baseplate 12 by an angle of between 1° and 5°. Since the baseplate 12 is normally placed on a vertical surface the deflective curvilinear projection 14 will generally be placed at a downward angle from the horizontal. This is to prevent any liquid or dry particulate matter from accumulating in recessed area of the deflective curvilinear projection and therefore entering the connectors of the outlet or jack that the cover plate is protecting.

The deflective curvilinear projection 14 is integrally molded with the baseplate 12 with the deflective curvilinear projection 14 of a heat resistant, non-electrically conductive material such as a nonconductive organic polymer. The deflective curvilinear projection 14 has all exposed edges rounded or blunted to eliminate sharp edges for consumer safety and to prevent diminishing the integrity of electrical insulating materials of electric power receiving cords. The length of projection 14 is roughly, but not limited to 7.6 to 8.9 centimeters at the point furthest from baseplate 12. This should be of correct length to function over electric and hot water baseboard heaters that are currently available. The end of the deflective curvilinear projection 14 is effectively angled to its upper horizontal edges to allow greater access to the outlet for power receiving cord connection.

After attachment of the heat deflecting curvilinear cover plate to an existing electrical or electronic connector, heated air emanating from below the connector, rises and is deflected away from the connector and any electrical or electronic cords or cables connected to the connector. This lessens the surface temperature of the connector and electrical or electronic cord(s) or cable(s) to prevent reducing the integrity of electrical insulating materials and combustible effects of repeated, rising, heated air flow.

Additional embodiments are shown in FIGS. 1B, 1C, 1D, and 1E. In each case the heat deflecting cover plate assemblies are similar with only the orientation of baseplate 12, diameter of the deflective curvilinear projection 14, or number of conventional screws 16 necessary for attachment altered to accommodate the type of outlet to which it will be affixed.

The placement of the cover plate assembly, some applications, may be in locations that may be exposed to moisture. The downward angle of the embodiment described above of the deflective curvilinear projection 14 will allow any water to flow away for the outlet or jacks that the cover plate assembly to which the cover plate assembly is attached. In other embodiments, the deflective curvilinear projection 14 may have opening, holes, or slots to allow the deflective curvilinear projection 14 to be porous to prevent any water from collecting in the accumulating in recessed area of the deflective curvilinear projection 14.

In some environments such a home hobby work area or garage or a workspace in a small commercial building, corrosive or conductive dust may fall and be drawn into the outlet sockets or jacks. To prevent this, various embodiments of this disclosure are shown in FIGS. 2A, 2B, 2C, 2D, and 2E. The embodiments shown substantially eliminate the effects of falling corrosive dust and other detrimental objects or substances by inverting the cover plate assembly as shown in FIGS. 1A, 1B, 1C, 1D, and 1E during installation of the cover plate assembly to the connectors of the electrical or electronic outlet or jack. This affords protection by the deflective curvilinear projection 14 extending over the connectors and the electrical or electronic cord or cable connection. In the applications where the cover plate assembly is deflecting falling dust and particulate matter, this matter all so may be moisture laden. In this application, the deflective curvilinear projection 14 must not have any opening to allow the moisture to flow through, but must be solid to deflect any moisture from the connectors of the outlets and jacks. Further, in these embodiments, the deflective projection 12 will be more perpendicular and may not the angle since the recess in these applications is placed downward.

While this invention has been particularly shown and described with reference to the preferred embodiments thereof, it will be understood by those skilled in the art that various changes in form and details may be made without departing from the spirit and scope of the invention. For example, baseplate 12 may have alternate shapes, may be manufactured from different materials to suit varied commercial applications or be used for dual (two gang) electrical outlets, etc.

What is claimed is:

1. A heated air and corrosive dust deflecting cover plate assembly for vertical surface mounted connectors for electrical or electronic outlets, jacks and other electrical apparatus comprising:

(a) a base plate having openings therein for receiving electrical or electronic connectors;

(b) a deflective projection having a semicircular cross-section and permanently and unremovably joined to the base plate and oriented such that heated air or corrosive dust is deflected from power cords or cables coupled to the receiving electrical or electronic connectors and from the receiving electrical or electronic connectors and is at a small angle from perpendicular to said base plate, having a curvilinear shape with all exposed edges blunted; and (c) a means for affixing said base plate to said vertical surface mounted electrical outlets, jacks and other types of electrical apparatus.

2. The cover plate assembly as claimed in claim 1 wherein said means for affixing said base plate to the vertical surface are conventional screws, snaps, clips or other devices.

3. The cover plate assembly as claimed in claim 1 wherein fixed attachment for said deflective projection to said base plate is with mechanical fastenings, adhesive bonding, integral molding with the base plate, or by other attachment devices or methods to securely seal the deflective projection to the base plate to prevent access of the heated air or corrosive dust from the receiving electrical or electronic connectors.

4. The cover plate assembly as claimed in claim 1 wherein said deflective projection extends from the lower portion of said base plate to extend beyond a heat producing apparatus placed immediately below the base plate.

5. The cover plate assembly as claimed in claim 4 wherein said deflective projection has a length to extend electrical or electronic cords or cables connected to the connector to which the cover plate assembly is attached beyond the heat producing apparatus to protect power cords or cables from heat deterioration.

6. The cover plate assembly of claim 5 wherein the deflective projection is approximately 7.6 to 8.9 centimeters in length.

7. The cover plate assembly as claimed in claim 4 wherein said deflective projection is comprised of a heat resistant material that is electrically nonconductive.

8. The cover plate assembly of claim 6 wherein the baseplate with the projection is formed of an organic polymer or other heat resistant, moldable material.

9. The cover plate assembly as claimed in claim 1 wherein said deflective projection extends from the upper portion of said baseplate to extend beyond the base plate to deflect particulate matter.

10. The cover plate assembly as claimed in claim 6 wherein said deflective projection is of a sufficient length to deflect corrosive dust and other detrimental, electrically conductive or corrosive objects and substances from wall outlet sockets or connectors.

11. The cover plate assembly of claim 8 wherein the deflective projection is approximately 7.6 to 8.9 centimeters in length.

12. The cover plate assembly of claim 1 wherein the small angle of the curvilinear deflective projection is from approximately 1° to approximately 5° from the perpendicular to the base plate to prevent collection of moisture within the recess of the curvilinear deflective projection.

* * * * *